United States Patent [19]

Brown

[11] 4,060,869

[45] Dec. 6, 1977

[54] APPARATUS FOR FORM FITTING SHOES AND BOOTS

[76] Inventor: Dennis N. Brown, 8528 Custer School Road, Custer, Wash. 98240

[21] Appl. No.: 694,366

[22] Filed: June 9, 1976

Related U.S. Application Data

[63] Continuation-in-part of Ser. No. 560,740, March 21, 1975.

[51] Int. Cl.[2] ..... A43D 5/00

[52] U.S. Cl. ..... 12/115.2

[58] Field of Search ..... 12/114.4, 115.2, 142 R

[56] References Cited

U.S. PATENT DOCUMENTS

| | | | |
|---|---|---|---|
| 1,024,869 | 4/1912 | Smith | 12/115.2 |
| 1,289,927 | 12/1918 | Scheritz | 12/115.2 |
| 2,086,917 | 7/1937 | Lattemann | 12/115.2 |
| 3,952,357 | 4/1976 | O'Sullivan | 12/115.2 |

*Primary Examiner*—Patrick D. Lawson

*Attorney, Agent, or Firm*—Blair & Brown

[57] ABSTRACT

The form fitting of shoes and boots of the instant invention includes the heating of the area of the foot gear which needs to be enlarged to accommodate the foot and simultaneously applying pressure from the inside of the foot gear to cause the heated portion of the foot gear to expand the desired amount. Pneumatically or hydraulically actuated cylinders are used within the foot gear to provide the required pressure and a number of different shoe contacting members are interchangeable to assist in shaping the expanded portion of the foot gear.

5 Claims, 32 Drawing Figures

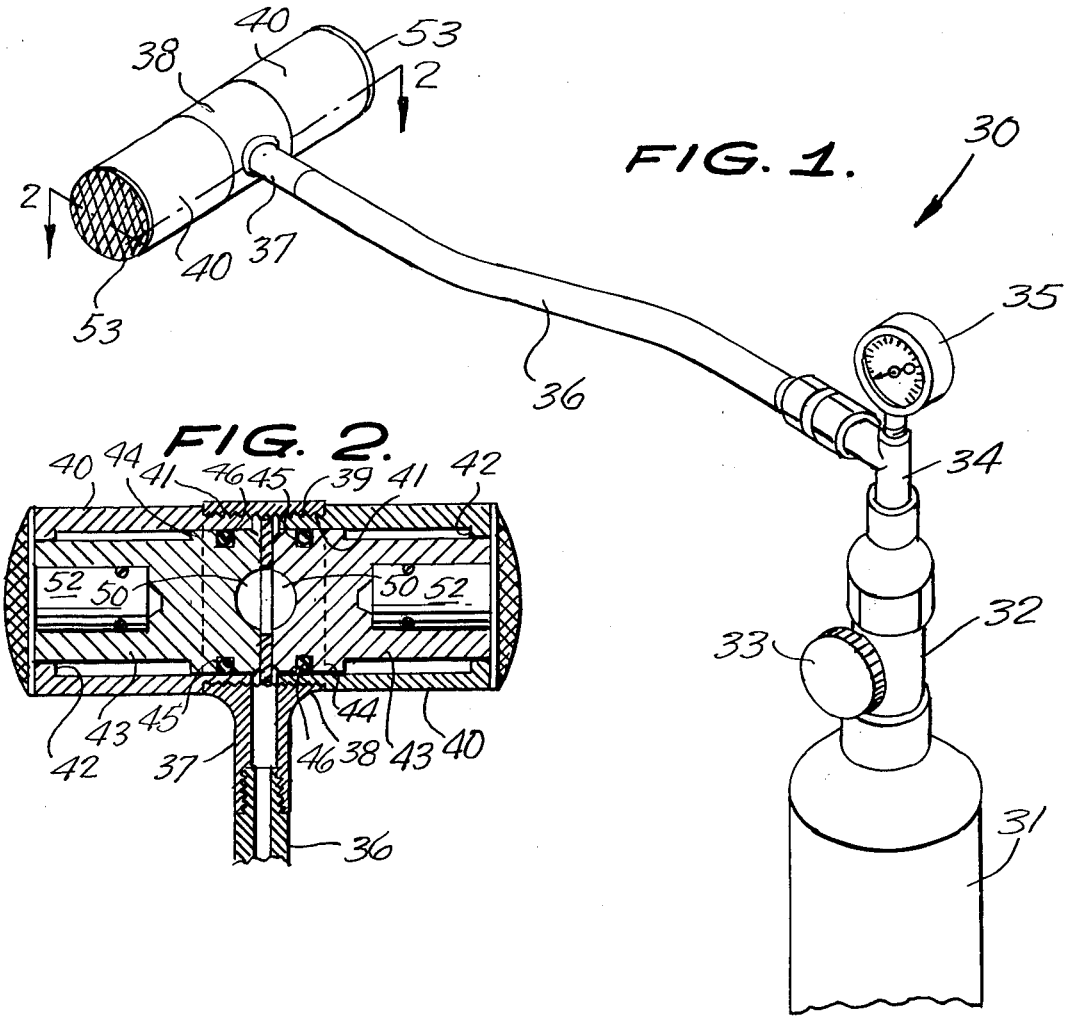
FIG. 1.
30
35
34
32
33
31
36
37
38
40
53
2
2
40
53
FIG. 2.
40
44
41
46
45
39
41
42
52
50
50
52
43
45
42
37
46
38
43
40
44
36
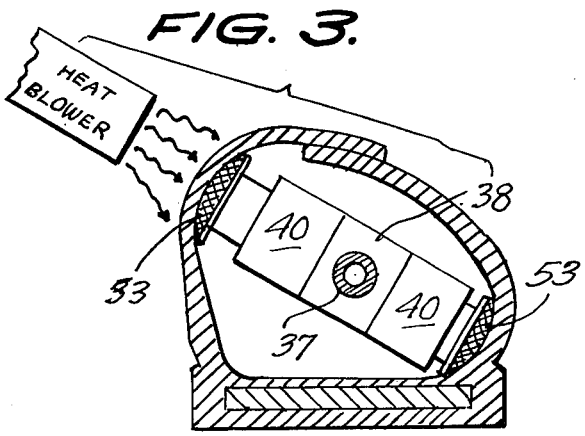
FIG. 3.
HEAT BLOWER
38
40
40
53
53
37
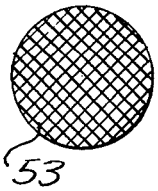
FIG. 4.
53
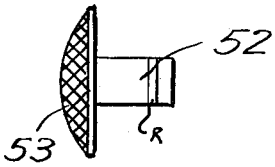
FIG. 5.
52
53
R
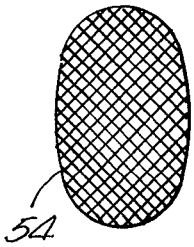
FIG. 6.
54
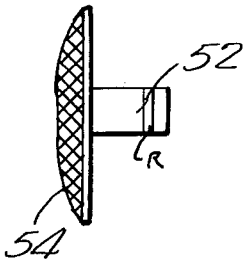
FIG. 7.
52
R
54

FIG. 21.
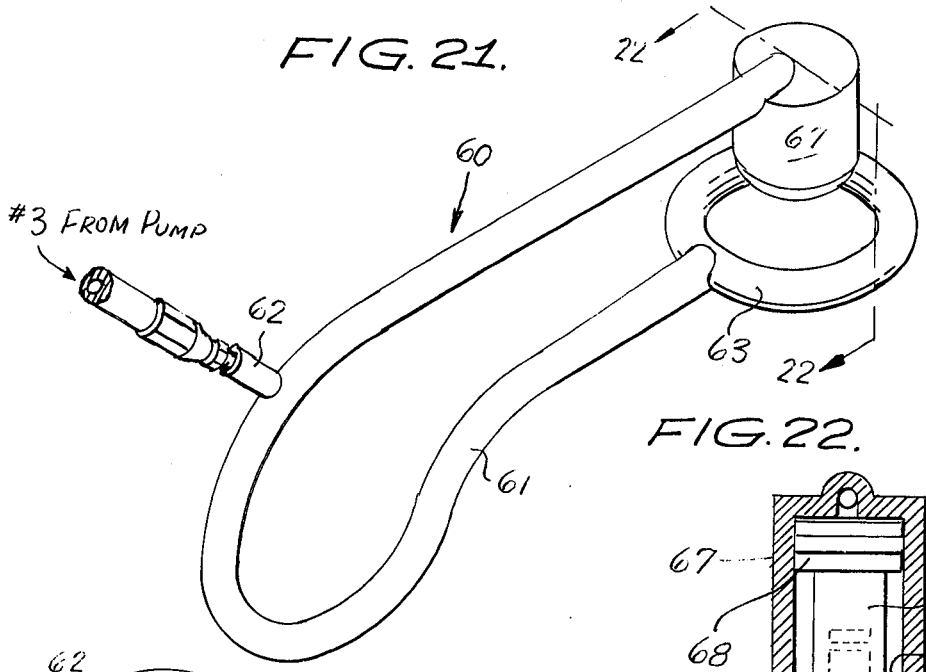
FIG. 22.
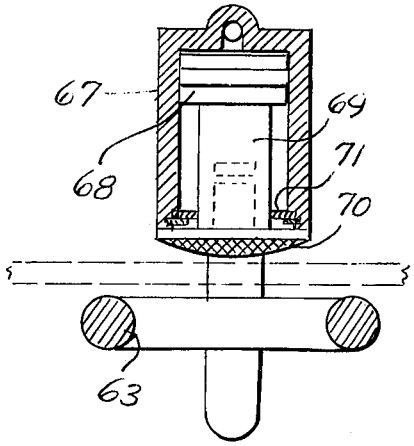
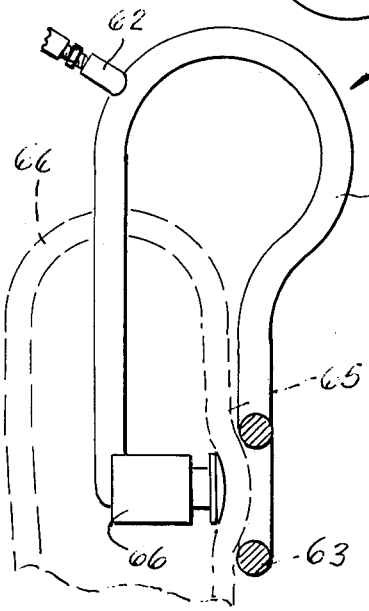
FIG. 20.
FIG. 19.
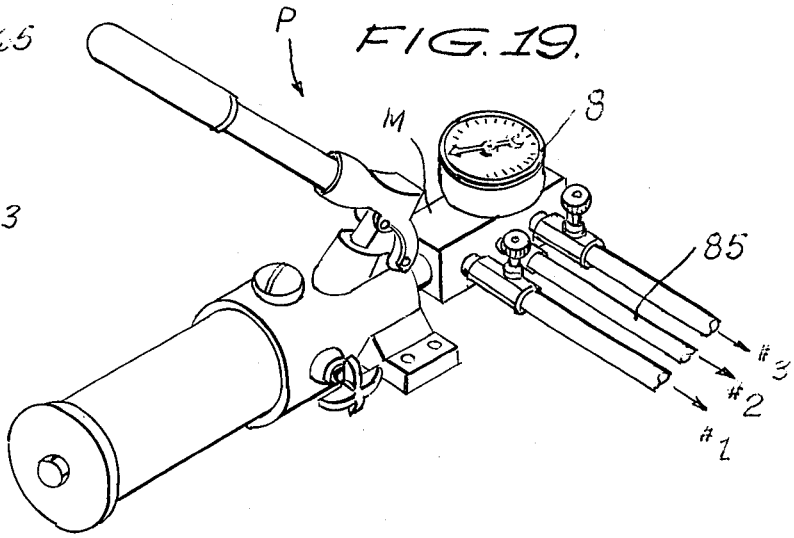

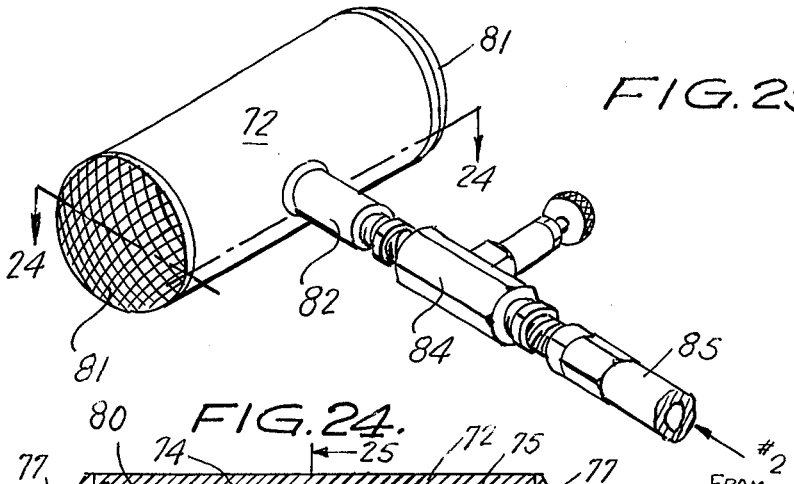
FIG. 23.
FIG. 24.
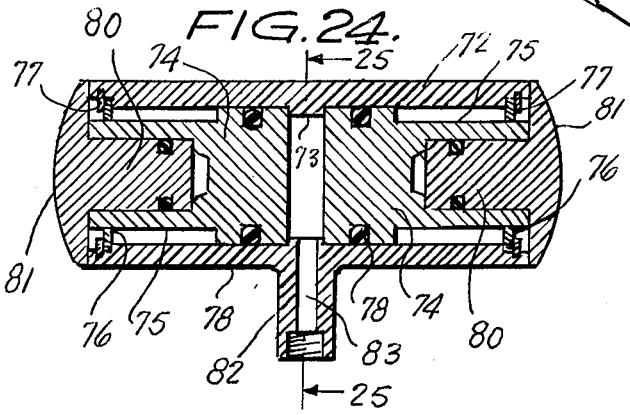
FIG. 25.
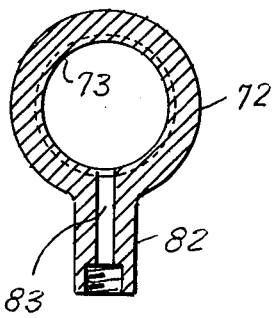
FIG. 26.
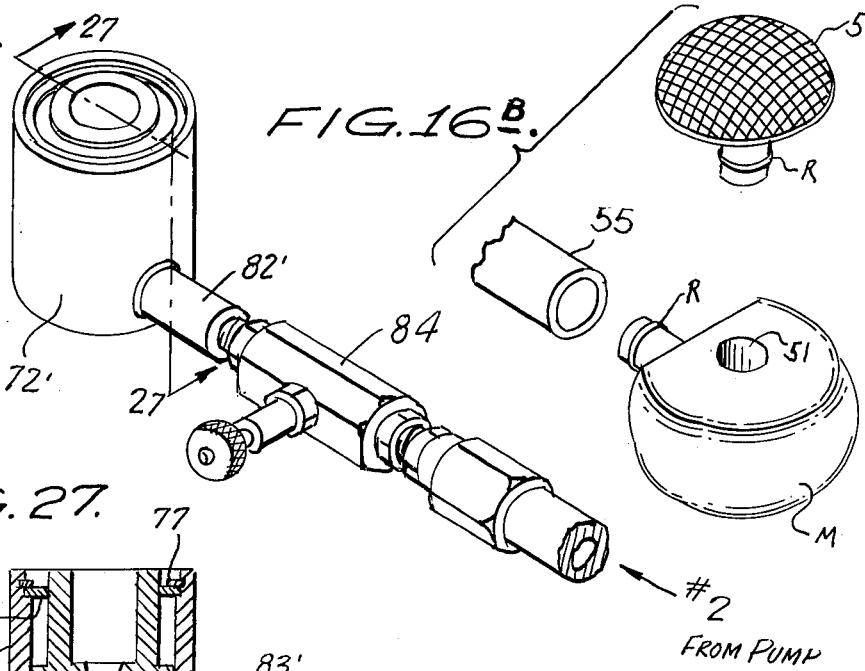
FIG. 16B.
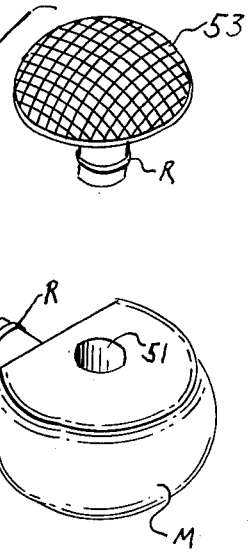
FIG. 27.
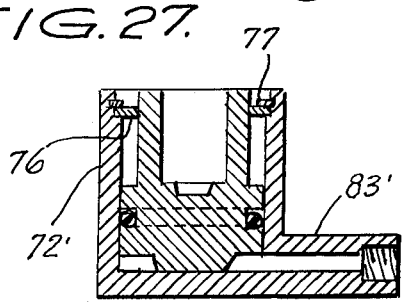

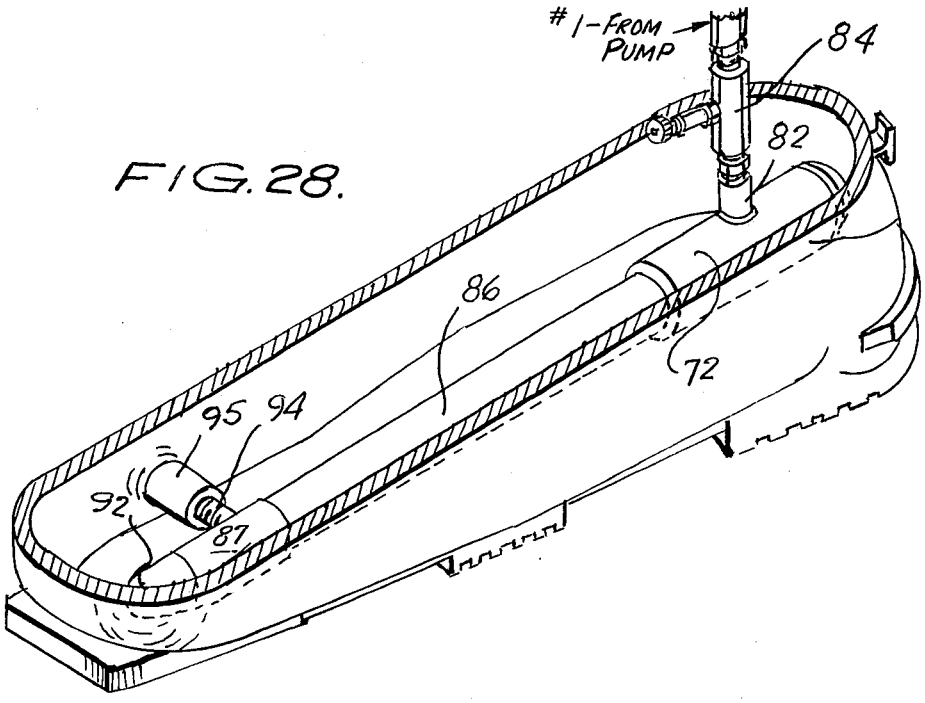
FIG. 28.
FIG. 29.
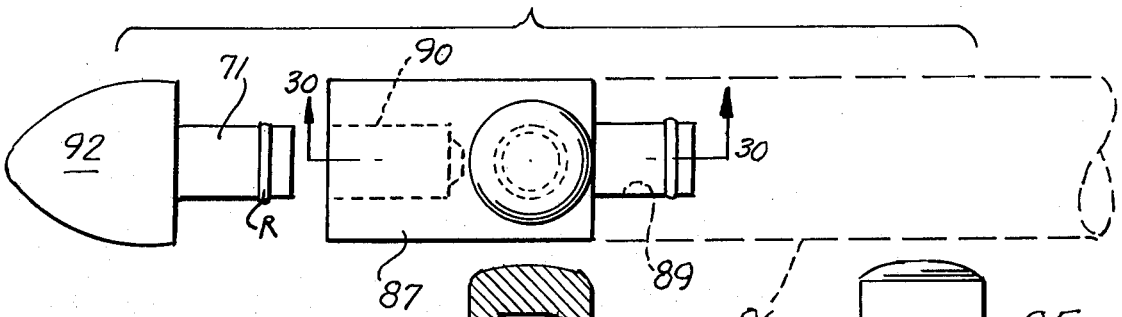
FIG. 30.
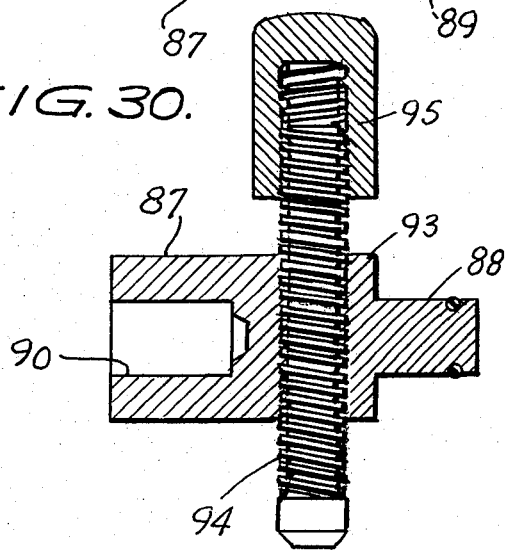
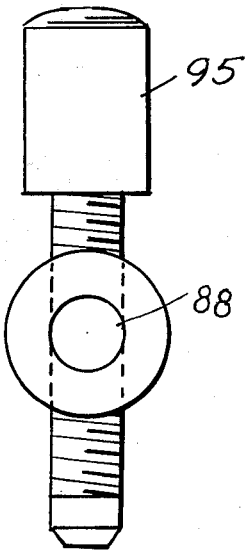
FIG. 31.

APPARATUS FOR FORM FITTING SHOES AND BOOTS

CROSS REFERENCE TO RELATED APPLICATION

This application is a continuation-in-part of my copending application Ser. No. 560,740 filed Mar. 21, 1975 entitled METHOD AND APPARATUS FOR FORM FITTING SHOES AND BOOTS.

BACKGROUND OF THE INVENTION

FIELD OF THE INVENTION

The present invention relates to apparatus for locally enlarging foot gear so as to adapt the foot gear to the foot of the wearer.

The primary object of the invention is to provide an apparatus for permanently enlarging a local portion of a foot gear to adapt it to the foot of the user.

Other objects and advantages will become apparent in the following specification when considered in light of the attached drawings.

BRIEF DESCRIPTION OF THE DRAWINGS

FIG. 1 is a perspective view of the apparatus used in the method of form fitting foot gear;

FIG. 2 is an enlarged fragmentary sectional view taken on the line 2—2 of FIG. 1, looking in the direction of the arrows;

FIG. 3 is a sectional view of the apparatus in use in a ski boot;

FIG. 4 is an elevational view of one of the forming pads used with the method;

FIG. 5 is a side elevation of the pad shown in FIG. 4;

FIG. 6 is an elevation view of another pad used with the method;

FIG. 7 is a side elevation of the pad shown in FIG. 6;

FIG. 16B is an exploded perspective view of the toe attachments shown in FIG. 16A;

FIG. 19 is a perspective view of the pump used with the invention;

FIG. 20 is a side elevation of another modified form of the invention shown in boot shaping position;

FIG. 21 is a perspective view of the C-member illustrated in FIG. 20;

FIG. 22 is an enlarged cross sectional view taken on the line 22—22 of FIG. 21, looking in the direction of the arrows;

FIG. 23 is a perspective view of a still further modified form of the invention;

FIG. 24 is a sectional view taken on line 24—24 of FIG. 23 looking in the direction of the arrows;

FIG. 25 is a transverse cross section taken on line 25—25 of FIG. 24 looking in the direction of the arrows;

FIG. 26 is a perspective view of another modified form of the invention;

FIG. 27 is a transverse cross section taken on the line 27—27 of FIG. 26 looking in the direction of the arrows;

FIG. 28 is a perspective view of still another modified form of the invention;

FIG. 29 is an exploded end elevation of the invention illustrated in FIG. 28;

FIG. 30 is a sectional view taken on the line 30—30 of FIG. 29 looking in the direction of the arrows; and FIG. 31 is a side elevation of the structure shown in FIG. 30.

DESCRIPTION OF THE PREFERRED EMBODIMENTS

Figure 8:
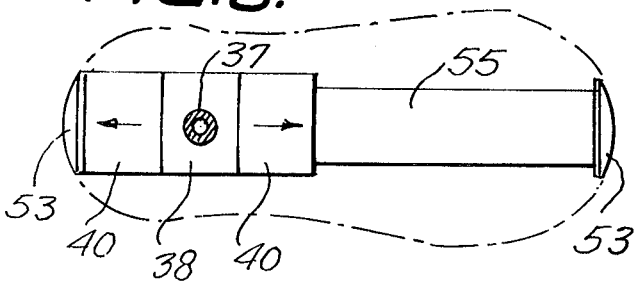
FIG. 8 is a sectional view of the apparatus with an extension applied thereto.
Figure 9:
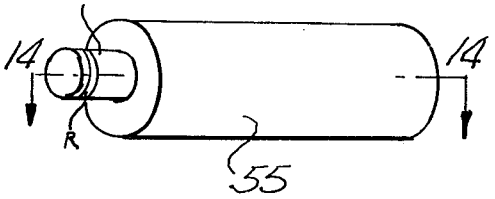
FIG. 9 is a perspective view of the extension used in FIG. 8.
Figure 10:
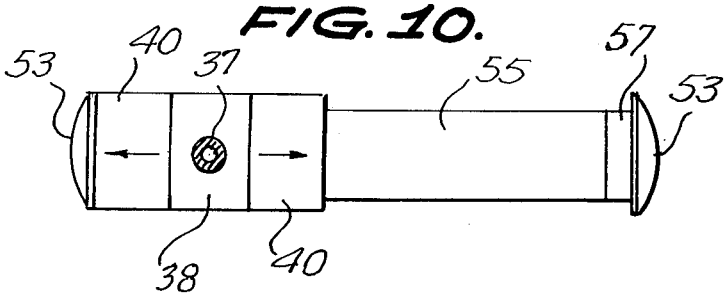
FIG. 10 is a view similar to FIG. 8 of another attachment.
Figure 11:
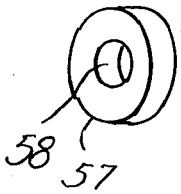
FIG. 11 is a perspective view of the attachment illustrated in FIG. 10.
Figure 12:
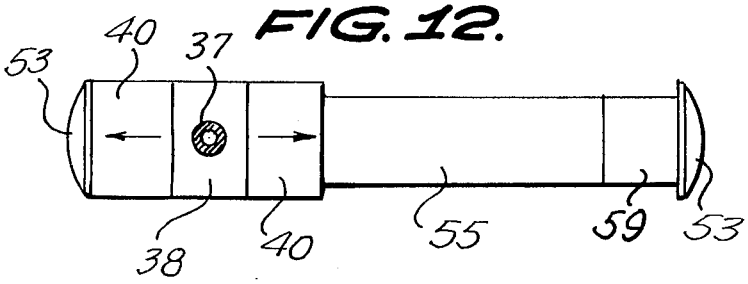
FIG. 12 is a view similar to FIG. 8 of still another attachment.
Figure 13:
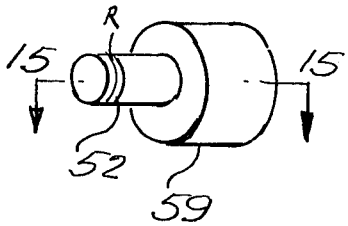
FIG. 13 is a perspective view of the attachment illustrated in FIG. 12.
Figure 14:
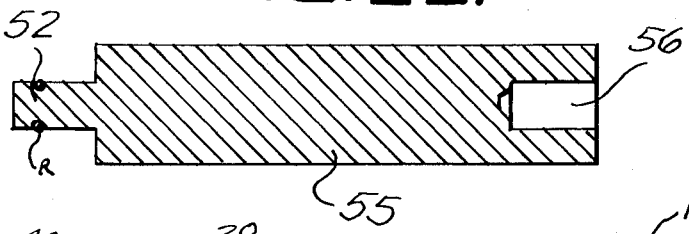
FIG. 14 is a longitudinal sectional view taken along the line 14—14 of FIG. 9, looking in the direction of the arrows.
Figure 15:
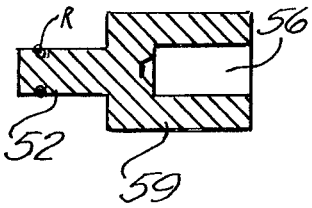
FIG. 15 is a longitudinal sectional view taken on the line 15—15 of FIG. 13, looking in the direction of the arrows.

Referring now to the drawings in detail wherein like reference characters indicate like parts throughout the several figures the reference numeral 30 indicates generally the pressure applying apparatus of the instant invention.

The pressure applying apparatus 30 includes a compressed air bottle 31 or if desired a source of hydraulic fluid under pressure which is controlled by a valve 32 having a hand knob 33 associated therewith. A fitting 34 extends upwardly from the valve 32 and has a pressure gauge 35 mounted thereon. An elongate handle tube 36 is connected to the fitting 34 and extends to a fitting 37 forming part of a base member 38.

The base member 38 is generally cylindrical in cross section and is internally threaded at 39 for reasons to be assigned.

A hollow cylinder 40 has an externally threaded reduced diameter portion 41 at one end thereof which is threaded into the threads 39 of the base member 38 on each side thereof. The hollow cylinder 40 has an internal flange 42 formed at the end thereof opposite the externally threaded reduced diameter portion 41 for reasons to be assigned.

Figure 18:
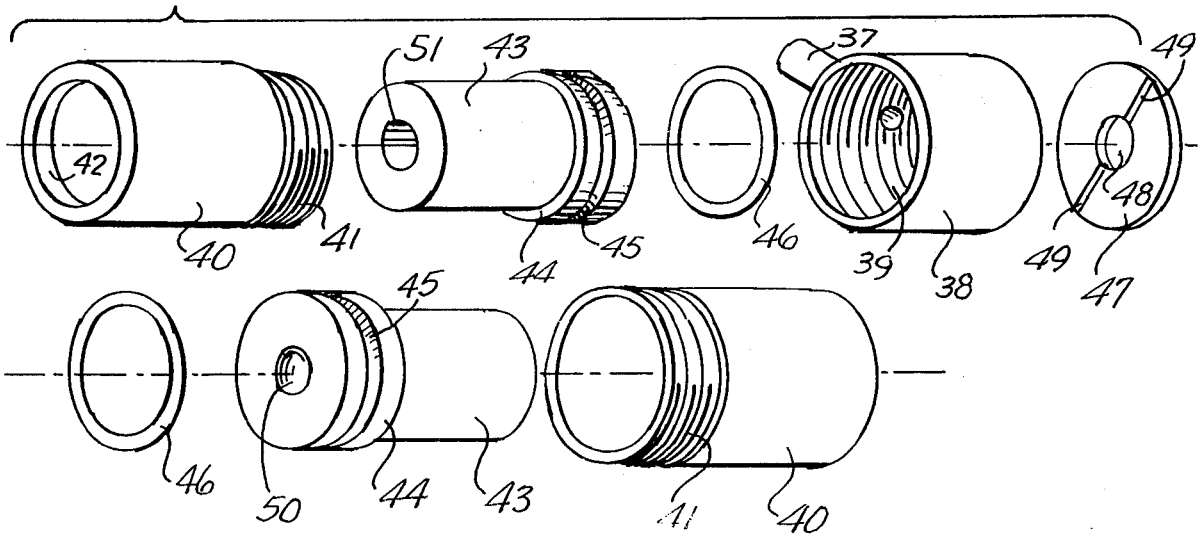
FIG. 18 is an exploded perspective view of the central unit of the apparatus.

A piston 43 is mounted for reciprocation in the cylinder 40 and has a shouldered portion 44 which engages the flange 42 to prevent the piston 43 from moving completely out of the cylinder 40. The shouldered portion 44 has an annular groove 45 formed therein to receive an O-ring seal 46 as can be clearly seen in FIGS. 2 and 18. A washer 47 having an axial bore 48 formed therein is positioned between the cylinders 40 centrally of the body 38. The opposite faces of the washer 47 are provided with radial grooves 49 to permit the flow of fluid from fitting 37 inwardly to the central bore 48. The inner ends of the pistons 43 have a recess 50 formed therein to permit the free flow of fluid from the bore 48.

The outer ends of the pistons 43 are provided with bores 51 to receive cylindrical bodies 52 for reasons to be assigned. Each of the bodies 52 are provided with O-rings R to assist in holding the bodies 52 in the bores.

A generally circular knurled contact member 53 has a cylindrical body member 52 integrally formed thereon as can be seen in FIGS. 4 and 5. An elongate domed member 54 also knurled on it's outer surface is similarly provided with a cylindrical body 52. The members 53,54 are used interchangeably in accordance with the shape to be given to the foot gear as it is expanded.

In some instances the effective length between the cylinders 40 must be increased and this is done with an adaptor 55 having a body 52 formed on one end thereof and a bore 56 formed in the opposite end thereof. A washer 57 having a bore 58 therein permits relatively short additions to be made to the length of the apparatus. An immediate adaptor 59 is identical to the adaptor 55 with the exception that it is shorter in overall length. As can be seen in FIGS. 8 through 17 the effective length between cylinders 40 can be varied to any degree necessary in order to adapt the apparatus to the foot gear needing shaping.

In some instances when found desirable to have expansion from only one side of the body 38 one of the cylinders 40 can be replaced with a dummy cylinder 40 solid at its inner end instead of having the piston 43 mounted therein.

Figure 16A:
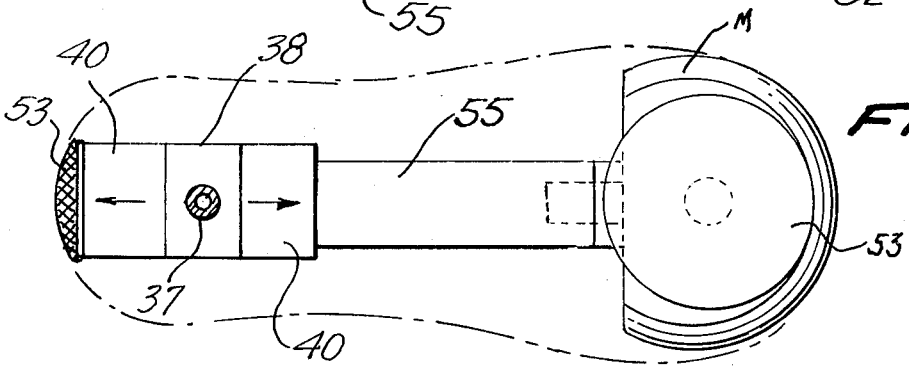
FIG. 16A is a view similar to FIG. 3 with several of the attachments shown in use.
Figure 17:
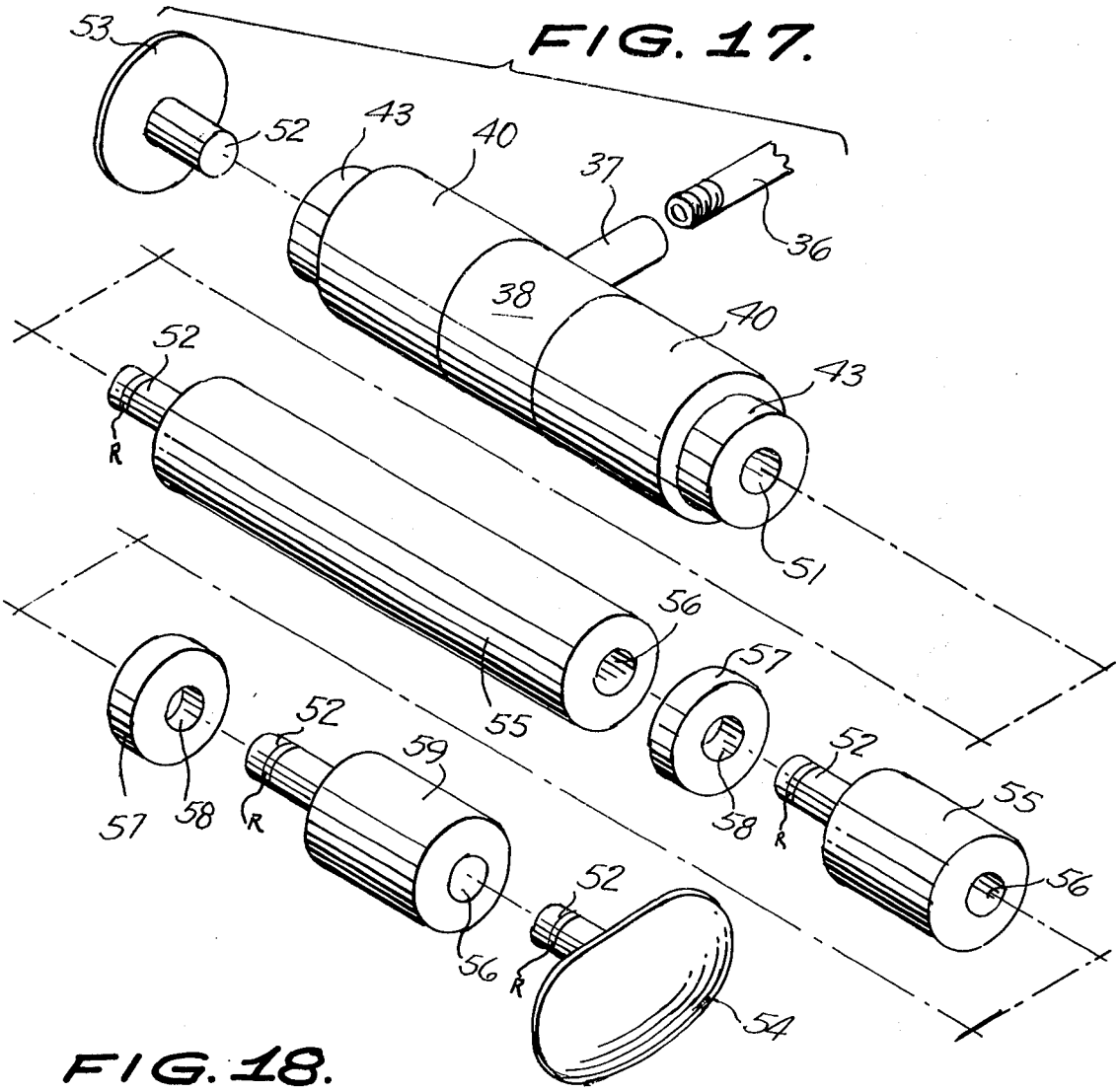
FIG. 17 is an exploded perspective view of the invention.

In FIGS. 16$^{A}$ and 16$^{B}$ a truncated semi-spherical member M is used and has a bore 51 to receive the member 53 on its upper surface. This arrangement is used for expanding the complete toe area.

Referring now to FIG. 19, a hand operated hydraulic pump is illustrated generally at P. The pump P includes a manifold M, with a pressure gauge G connected thereto. Three output lines No. 1, No. 2 and No. 3 extend from the manifold M to the units to be actuated.

In FIGS. 20 through 22 a generally U-shaped unit 60 includes a tube 61 having a fitting 62 connected centrally thereto. One end of the unit 60 is provided with an open solid ring 64 which is adapted to engage the outer face 65 of foot gear 66 to be shaped. A cylinder 67 is integrally mounted on the opposite end of the unit 60 and contains a piston 68, connecting rod 69 and a dome member 70 as can be best seen in FIG. 22. A retainer ring 71 secures the piston 68 within the cylinder 67. In the form of the invention illustrated in FIGS. 20 through 22 the foot gear is heated in the area to be expanded and the dome shaped member 70 is pressed toward the ring 63 centrally thereto so as to reshape the foot gear 66 as needed.

A modified form of the invention is illustrated in FIGS. 23 through 25 and includes a cylinder 72 open at each end and having an internal reduced diameter stop 73 intermediate the opposite ends thereof. A piston 74 is mounted in each end of the cylinder 72 and has a reduced diameter barrel 75 which engages a retainer washer 76 in the cylinder 72 secured in place by a lock ring 77.

An O-ring seal 78 is mounted in the head of each piston 74 and engages the inner wall of the cylinder 72 to seal the piston for sliding movement therein. A socket 79 is formed in each of the pistons 74 to receive a post 80 of a dome member 81.

A fitting 82 is integrally formed on the cylinder 72 and has a passage 83 extending therethrough and communicating with the space between the pistons 74. A hand controlled valve 84 is secured to the fitting 82 and to a hose 85 extending from the No. 2 outlet of the pump P.

The use and operation of the modified form of the invention illustrated in FIGS. 23 through 25 is identical to that of the form of the invention illustrated in FIG. 1.

A further modified form of the invention is illustrated in FIGS. 26 and 27 and consists of a half cylinder 72' having only one open end and containing one piston 74. A retainer washer 76 and lock ring 77 secure the piston 74 in place in the half cylinder 72'. A fitting 82' is integrally formed on and communicates with the closed end of the cylinder 72'. A valve 84 connects the fitting 82' to the bore 85.

The use and operation of the invention illustrated in FIGS. 26 and 27 is similar to that of FIG. 1 but restricted to points of use wherein expansion in a single direction is required.

In FIGS. 28 through 31 further modified attachments for the cylinder 72 are disclosed.

The cylinder 72 has a dome extension 86 secured to the piston 74 (not shown) at one end with a fitting 87 removably mounted on its outer end. The fitting 87 has a port 88 on one end to enter a socket 89 on the outer end of the extension 86. A socket 90 is formed in the opposite end of the fitting 87 to receive a post 91 of a dome member 92.

The fitting 87 has a threaded transverse bore 93 having a threaded post 94 extending therethrough. A head 95 is threaded onto one end of the post 94 for reasons to be assigned.

The invention disclosed in FIGS. 29 through 31 are used in situations wherein the dome member 92 must be supported against lateral movement within the foot gear when the position of expansion is off center. The head 95 is engaged against the side of the boot in order to steady the dome member 92 when used in otherwise the same manner as the FIG. 1 apparatus.

Having thus described the preferred embodiment of the invention it should be understood that numerous structural modifications and adaptations may be resorted to without departing from the spirit of the invention.

What is claimed is:

1. An apparatus for internally expanding foot gear comprising a fluid pressure cylinder, at least one fluid pressure actuated piston mounted in said cylinder for reciprocation therein, a domed member detachably mounted on said piston for engagement with the inner surface of the foot gear to apply pressure thereto, a second dome member and means on said cylinder for supporting said second dome member for engagement with said foot gear oppositely of said first named dome member.

2. A device as claimed in claim 1 wherein said means for supporting a second dome member includes a second piston mounted in said cylinder for reciprocation therein oppositely of said first named piston.

3. A device as claimed in claim 2 including adaptors positioned between said pistons and said dome members for increasing the effective length of said pistons.

4. A device as claimed in claim 3 wherein said dome members are elongate for shaping said foot gear.

5. A device as claimed in claim 3 wherein adjustable transverse means are provided in said adaptors to maintain the effective position of said dome member during use.

* * * * *